US005345798A

United States Patent [19]

Nakai

[11] Patent Number: 5,345,798

[45] Date of Patent: Sep. 13, 1994

[54] CODE LOCK DEVICE

[75] Inventor: Hatsuo Nakai, Toyonaka, Japan

[73] Assignee: Clover Co., Ltd., Osaka, Japan

[21] Appl. No.: 42,503

[22] Filed: Apr. 2, 1993

[30] Foreign Application Priority Data

Jan. 21, 1993 [JP] Japan ..... 5-027361

[51] Int. Cl.[5] ..... E05B 37/00

[52] U.S. Cl. ..... 70/284; 70/312; 70/314; 70/316

[58] Field of Search ..... 70/284–286, 70/304–306, 308, 309, 311, 312–318

[56] References Cited

U.S. PATENT DOCUMENTS

| | | | |
|---|---|---|---|
| 3,667,261 | 6/1972 | McGourty | 70/318 X |
| 4,290,286 | 9/1981 | Rae | 70/285 |
| 4,520,641 | 6/1985 | Bako | 70/314 |
| 4,671,088 | 6/1987 | Jeang | 70/284 |
| 4,732,021 | 3/1988 | Su | 70/312 |
| 4,770,013 | 9/1988 | Nakai | 70/285 |
| 4,831,860 | 5/1989 | Sheiman et al. | 70/312 |
| 4,885,923 | 12/1989 | Nakai | 70/284 |
| 4,938,044 | 7/1990 | Chang | 70/315 |
| 5,092,149 | 3/1992 | Bartsch et al. | 70/312 |
| 5,235,831 | 8/1993 | Lauria et al. | 70/312 |

*Primary Examiner*—Peter M. Cuomo
*Assistant Examiner*—Suzanne L. Dino
*Attorney, Agent, or Firm*—Jordan and Hamburg

[57] ABSTRACT

A code lock device comprising an actuator responding to a release operation and a locking operation, and an actuation which performs reciprocating motion and normal and reverse rotation. A plurality of dials for setting a release code series and a plurality of drive plates each of which responds to each dial and integrally rotates with each actuation shaft are provided on the actuation shaft, and a dial enforced reset mechanism is equipped between each drive plate and each corresponding dial. This dial enforced reset mechanism makes each drive plate and each corresponding dial engage each other by an engaging means in response to reciprocating motion and normal and reverse rotation of the actuation shaft in the case of the release operation or the locking operation, and makes each dial forcibly rotate to break the release code series in response to rotation of the actuation shaft.

4 Claims, 9 Drawing Sheets

CODE LOCK DEVICE

BACKGROUND OF THE INVENTION

1. Field of the Invention

This invention is related to code lock devices used for rental safes, rental lockers, doors and the like, and this invention relates more particularly to improvements of a code lock device in which a release code series is fixedly set and in which the release code series can be freely set.

2. Description of the Prior Arts

The conventional code lock devices include, according to their use, a type having only a code lock mechanism in which a release code series is fixedly set (hereinafter called "first type"), a type having only a code lock mechanism which can freely set a release code series (hereinafter called "second type"), a type having a code lock mechanism in which a release code series is fixedly set and a cylinder lock mechanism (hereinafter called "third type"), and a type having a code lock mechanism which can freely set a release code series and a cylinder lock mechanism (hereinafter called "fourth type").

The first and the third types are suitable for use by the same user because the release code series of the code lock is fixedly set, while the second and the fourth types are suitable for unspecified users because the release code series of the code lock can be freely set.

On locking, after aligning the release code series by dialing, in the first and the second types, a user grasps and turns a knob, and in the third and the fourth types, the user inserts a proper key into a keyhole of a cylinder lock and turns the key. Thereby a latch piece connected to the knob or the cylinder lock engages a brace of a counterpart. After that, the code lock is set to locking by suitably breaking down the release code series by dialing.

On releasing, after aligning the release code series by dialing, in the first and the second types, the user grasps and turns the knob in reverse, and the third and the fourth types, the user inserts the proper key into the keyhole of the cylinder lock and turns the key in reverse. Thereby the latch piece is released from the brace of the counterpart, and the doors of the safe and locker or the door can be opened. In the first and the third types, after locking, the release code series is broken down to keep the locking, or the release code series is broken down without locking.

However, if a user forgets to break the release code series on locking, in the fist and the second types, the code lock is not locked, and does not function as a lock. In the third and the fourth types, the cylinder lock becomes locked when pulling out a key, thus functioning as a lock, but if the key is stolen, the lock is released by the key, and crime prevention effect is reduced to half.

In addition, in the first and the third types, if a user forgets to break the release code series after unlocking, the release code series may be memorized by another person. As a result, even when locked, the first type is easily unlocked by another person, and in the third type, only the cylinder lock effectively functions, and thus the crime prevention effect is reduced to half.

SUMMARY OF THE INVENTION

The object of the present invention is to provide a code lock device which can automatically break a release code series by turning each dial forcibly in interlocking with a locking operation or a release operation, thereby enhancing the reliability of the code lock device greatly.

In accordance with this object, a code lock device of the present invention comprises an actuator responding to a release operation and a locking operation; an actuation shaft capable of reciprocating motion and normal and reverse rotation; a reciprocating mechanism which is provided between said actuator and said actuation shafts and reciprocates the actuation shafts in response to actuation of the actuator; a rotation mechanism which is provided between said actuator and said actuation shafts and rotates the actuation shafts in response to actuation of the actuator; a plurality of dials rotatably mounted on said actuation shafts; a locking mechanism which allows actuation of the actuator when a code .of each dial is in an alignment forming a release code series, and restrains the actuation of the actuator when the code of each dial is in a non-alignment; a plurality of drive plates each of which corresponds to each dial and integrally rotates with said actuation shafts; a dial enforced reset mechanism including an engaging means which is provided between each drive plate and each corresponding dial to engage both each other in response to reciprocating motion and rotation of the actuation shafts, and rotates each dial to a predetermined angular position.

In the above structure, when the actuator is actuated by the locking operation or the releasing operation, the actuation shafts reciprocates and rotates to engage each drive plate with each corresponding dial, and thereafter, rotates each dial to a predetermined angular position, and the release code series in alignment is automatically broken, and thus the reliability of the code lock device is greatly enhanced.

Furthermore, the code lock device of the present invention enables to break the release code series by reciprocating motion and rotation of one actuation shafts, thus realizing simplification of the structure of the lock device of this type and miniaturization of the device.

DESCRIPTION OF THE PREFERRED EMBODIMENT

Figure 1:
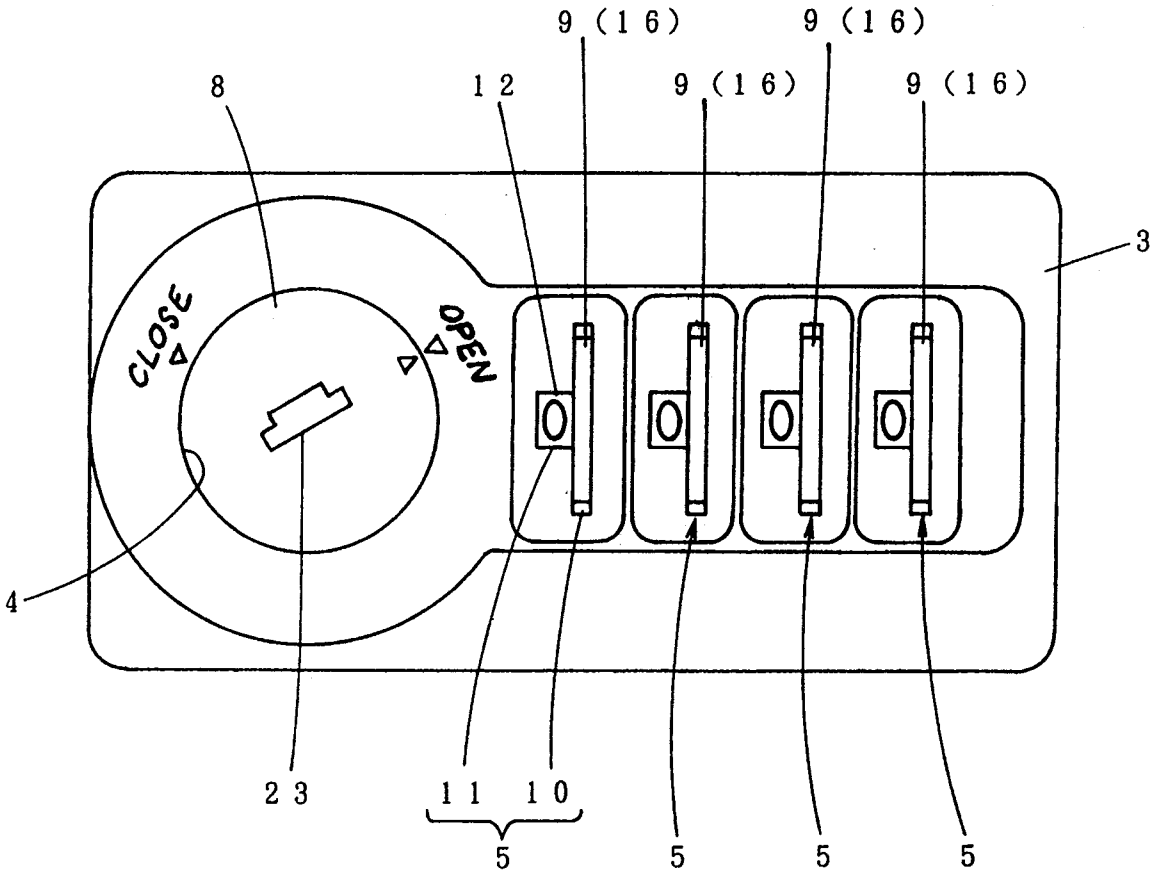
FIG. 1 is a plane view showing an appearance of a code lock device according to the present invention.

FIG. 1 shows an appearance of a code lock device of one embodiment of the present invention.

Figure 3:
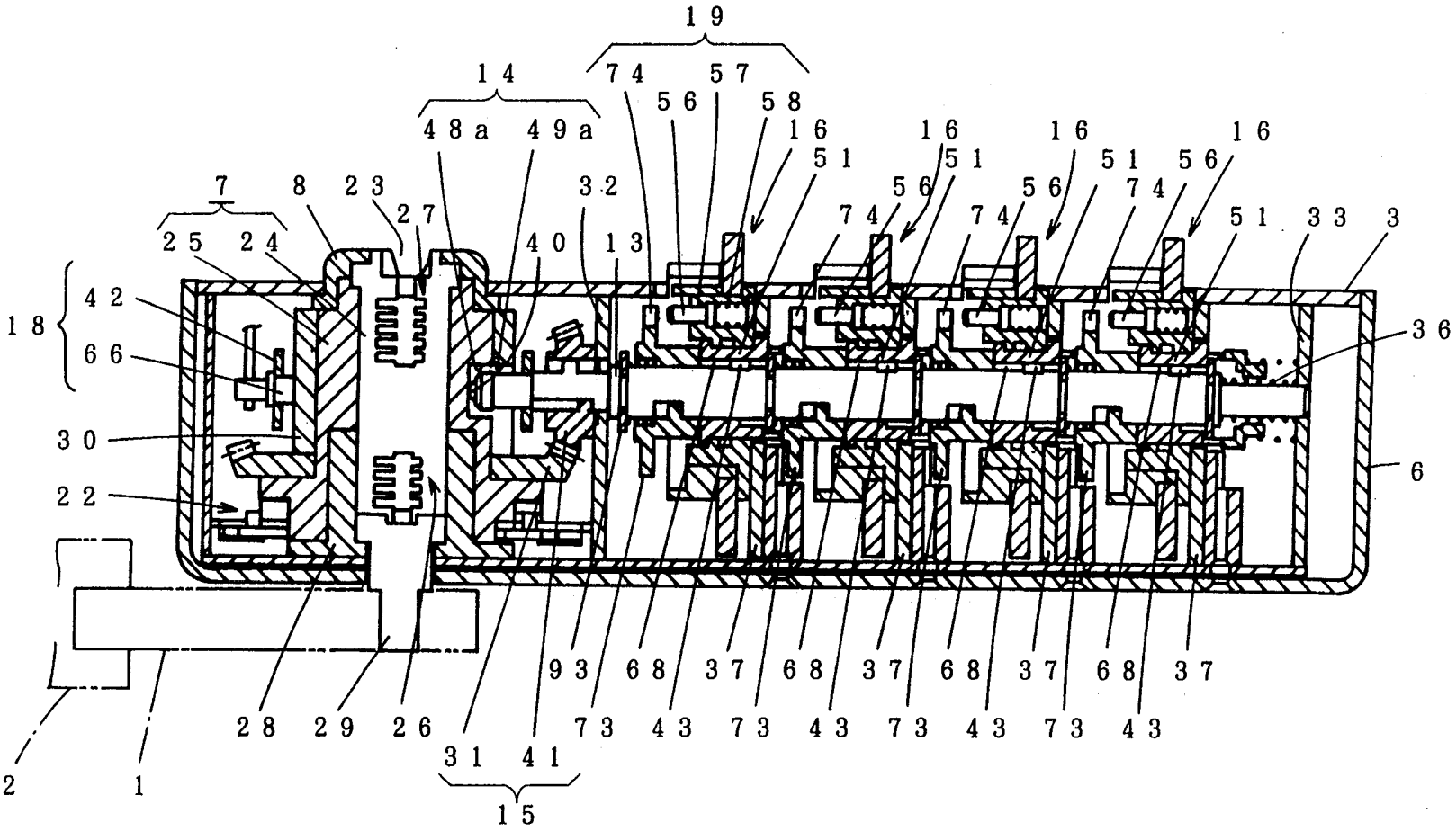
FIG. 3 is a longitudinal section view showing an internal structure of a code lock device which is seen in the direction of "a" in FIG. 2.

This code lock device is installed in, for example, a door of a rental safe, and a latch piece 1 shown in FIG. 3 rotates normally or reversely to engage with or disengage from a brace 2 mounted on a safe body.

In addition, in the following description, a state in which the latch piece 1 engages with the brace 2 is called "a closed state"; a state in which this closed state is locked and kept, "a locked state"; a state in which locking is released, "a released state" and a state in which the latch piece 1 disengages from the brace 2 is called "an open state". And, a manual operation from "an open state" to "a locked state" is called "a locking operation"; and a manual operation from "a closed state" to "an open state" via "a released state" is called "a release operation".

The code lock device of the illustrations comprises, in combination, a code lock mechanism in which a release operation and a locking operation become performable by bringing the release code series to a state of alignment, and a cylinder lock mechanism in which a release operation and a locking operation become feasible by inserting a proper key (not shown). This device corresponds to a type in which the release code series can be freely set, that is, the above fourth type. This invention is not limited to this type, but is applicable to the first type having only a code lock mechanism in which the release code series is fixedly set, and to the second type having only a code lock mechanism in which the release code series can be freely set, and also to the third type having a code lock mechanism in which the release code series is fixedly set and a cylinder lock mechanism.

In FIG. 1, numeral 3 is a front plate that covers a top face opening of a housing, which is provided with a circular opening 4 near one end portion of the plate face, and four window holes 5 over the center and the other end portion respectively.

In FIGS. 2–5, internal structures of the housing 6 are shown, and cylinder lock mechanism is arranged in the position corresponding to the above opening 4, and code lock mechanisms are disposed in the position corresponding to the above four window holes 5 respectively. An end plate 8 of the cylinder lock having a keyhole 23 is extruded on the front plate 3 from the opening 4, and dial operation plates 9 of dials 16 for setting four figures of the code lock are extruded on the front plate 3 from slots 10 of the window holes 5. As shown in FIG. 1, each window hole 5 has a rectangle hole 11 continuing to the slot 10 and the rectangle holes 11 are so made that numerals 12 indicated on respective four dials 16 can be seen through the holes.

In order to be enabled to freely set the release code series and to break the release code series to return it to zero, the illustrated code lock device comprises main structures including an actuator 7, an actuation shafts 13, a reciprocating motion mechanism 14, a rotation mechanism 15, four dials 16, a release code setting mechanism 17, a locking mechanism 18 and dial enforced reset mechanism 19, and furthermore, additive structures such as a dial intermittent advance mechanism 20, a dial operation restraining mechanism 21, and a return operation prevention mechanism 22.

Figure 2:
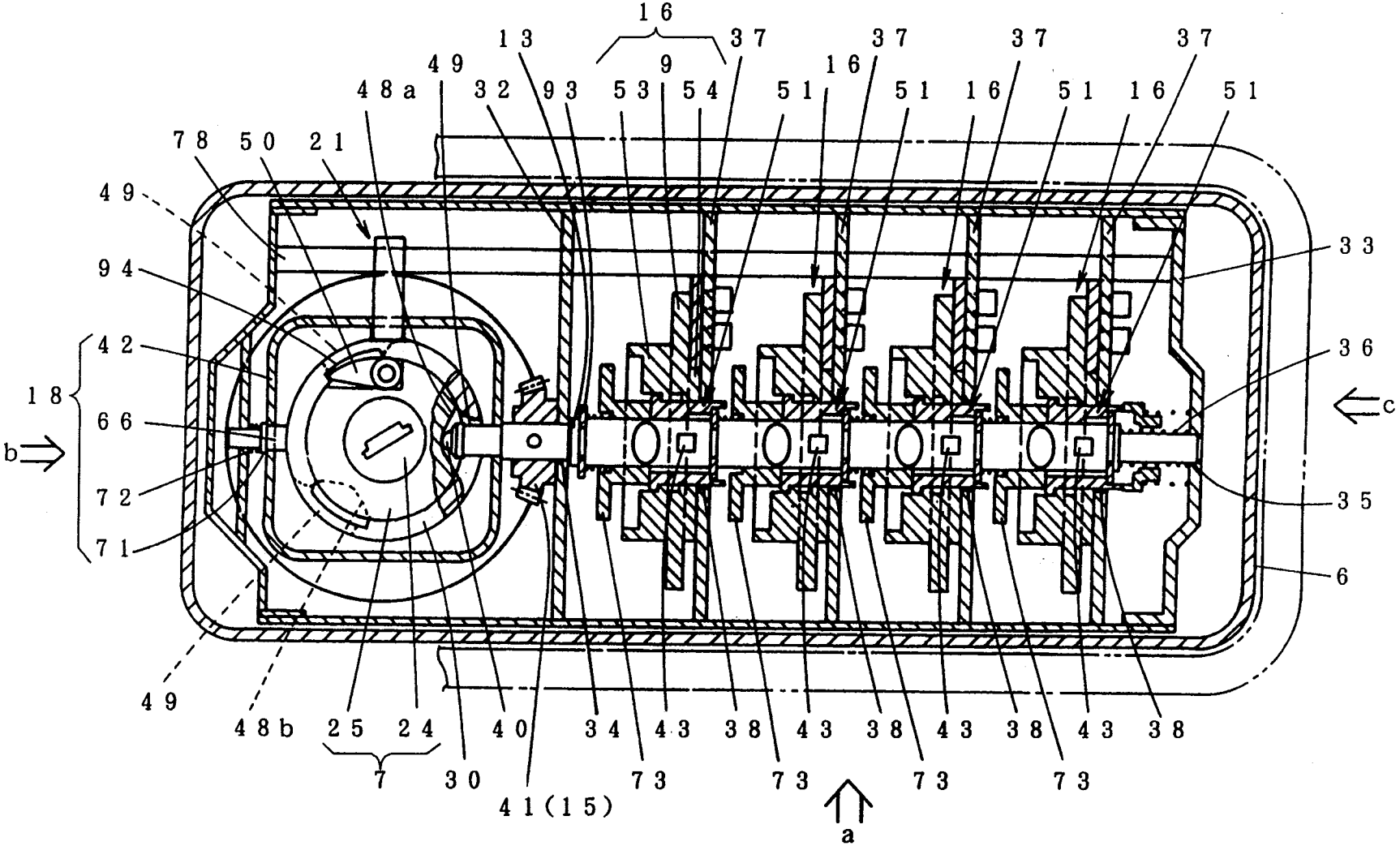
FIG. 2 is a section view showing an internal structure of a code lock device which is seen from the plane.
Figure 4:
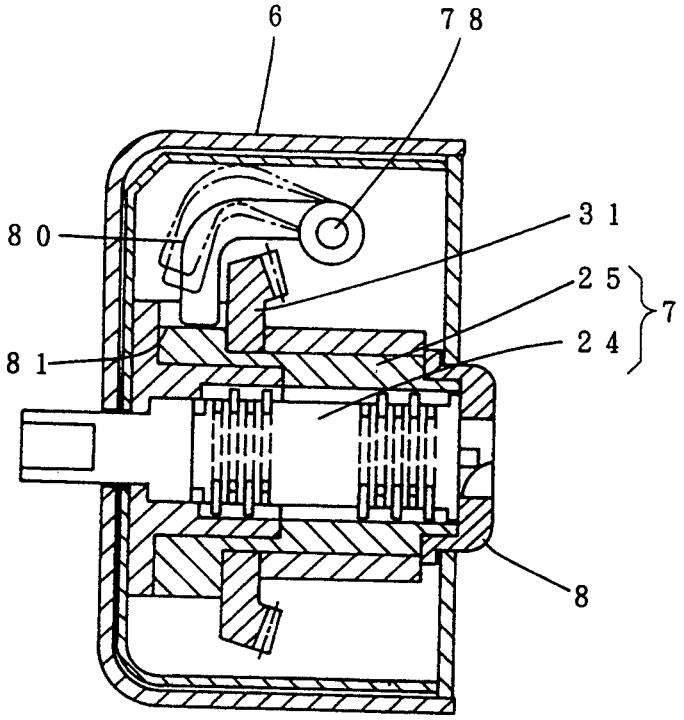
FIG. 4 is a longitudinal section view showing an internal structure of a code lock device which is seen in the direction of "b" in FIG. 2.
Figure 5:
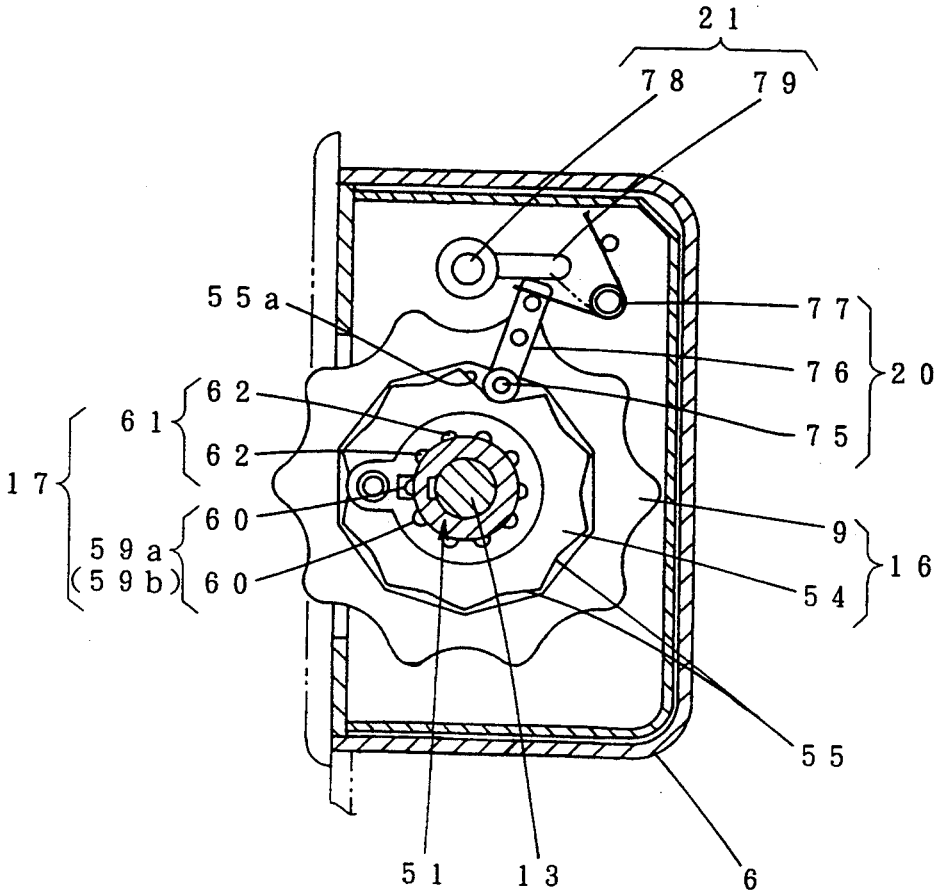
FIG. 5 is a longitudinal section view showing an internal structure of a code lock device which is seen in the direction of "c" in FIG. 2.

Examples of the above main structures and the additive structures will be concretely explained based on FIGS. 2–5. In addition, FIG. 2 is a section view showing a structure of a code lock device which is seen from the side of the front plate 3, FIG. 3 is a section view seen in the direction of "a" in FIG. 2, FIG. 4 is a section view seen in the direction of "b" in FIG. 2, and FIG. 5 is a section view seen in the direction of "c" in FIG. 2.

(1) Structure of actuator 7

The actuator 7 responds to a release operation and a locking operation, and in this embodiment, a mechanism of a well-known cylinder lock is used as the actuator 7. In this cylinder lock, when inserting a proper key into an inner cylinder 24 and then rotating it, in response to this operation, the inner cylinder 24 and an outer cylinder 25 rotate integrally. The latch piece 1 is mounted on the inner cylinder 24 through a mounting shaft 29 and, thus the latch piece 1 integrally rotates with the inner cylinder 24 in the normal or reverse direction.

In the interior of the above inner cylinder 24, first and a second lock mechanisms 26 and 27 both of which are composed of a plurality of disk tumblers, are assembled.

The first lock mechanism 26 restrains rotation of the inner cylinder 24 to a bushing 28, and under the conditions that a proper key or a master key has not been inserted, the inner cylinder 24 and the bushing 28 are in the state of engaging. The above master key is for emergency use when a user forgets the release code series.

The second lock mechanism 27 restrains rotation of the inner cylinder 24 to the outer cylinder 25, and under the conditions that the master key has not been inserted, the inner cylinder 24 and the outer cylinder 25 are always in the state of engaging.

Thus, when a proper key is inserted into the inner cylinder 24, only the first lock mechanism 26 operates to release the engagement between the inner cylinder 24 and the bushing 28. As a result, when turning the key, the inner cylinder 24 and the outer cylinder 25 rotate integrally.

When the master key is inserted into the inner cylinder 24, the first and the second lock mechanism 26 and 27 operate to release the engagement between the inner cylinder 24 and the bushing 28 and the engagement between the inner cylinder 24 and the outer cylinder 25. As a result, when turning the master key, only the inner cylinder 24 rotates.

A cylinder lock having such a structure is well-known, and thus the detailed explanation on the first and the second lock mechanisms 26 and 27 is omitted here.

A sleeve 30 which constitutes a reciprocating motion mechanism 14 and a locking mechanism 18 is rotatably fitted on outer cylinder 25, and a bevel gear 31 constituting a rotation mechanism 15 is also fitted on the outer periphery of the outer cylinder 25.

(2) Structure of actuation shaft 13

The actuation shaft 13 is horizontally provided in the direction perpendicular to the actuator 7, and both ends of the actuation shaft 13 are so supported by bearing holes 34 and 35 of supporting plates 32 and 33 that the shaft can reciprocate and rotate in the normal direction or in the reverse direction. One end of the actuation shaft 13 is linked to a compression spring 36, and the actuation shaft 13 is always activated by this spring pressure in the direction of the actuator 7. Between the supporting plates 32 and 33 at both ends of the shaft, four partition plates 37 are disposed with an equal spacing, and the actuation shaft 13 penetrates circular holes 38 formed in the respective partition plates 37.

The end face of the actuation shaft 13 is recessed, and in this recess a ball 40 is held which rolls on the outer periphery surface of the above outer cylinder 25 and the sleeve 30. The end portion of the actuation shaft 13 is slidably provided with a bevel gear 41 and a movable arm 42. On the peripheral surface of the actuation shaft 13, four protrusion pieces 43 are provided in the same angular positions, taking a constant spacing between them. These protrusion pieces 43 and the movable arm 42 constitute the locking mechanism 18, and its detail will be later described. In the figures, numeral 93 is a pushing ring, which pushes drive plates 73 that will be later described, and is integrally fixed to the actuation shaft 13.

(3) Structure of rotation mechanism 15

The rotation mechanism 15 comprises a bevel gear 31 mounted on the outer periphery of the above outer cylinder 25 and the bevel gear 41 provided on the end portion of the above actuation shaft 13. The engagement of these bevel gears 31 and 41 transmits rotation of the actuator 7 to the actuation shaft 13 to rotate it.

In the structure of the rotation mechanism 15, more concretely, gear tooth pitches of the bevel gears 31 and 41 are so determined that the actuation shaft 13 makes one revolution during transition from the above "open state" to "a closed state" or from "a closed state" to "an open state".

Figure 12:
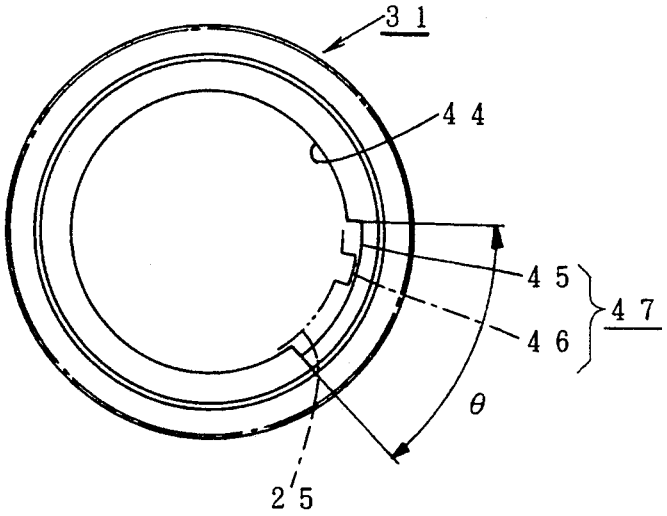
FIG. 12 is a plane view showing a bevel gear of a rotation mechanism.

As shown in FIG. 12, in the bevel gear 31, an engaging slot 45 having a predetermined angular range $\theta$ is formed on an inner hole 44, and this engaging slot 45 engages with a drive protrusion 46 provided protrusively on the outer peripheral surface of the outer cylinder 25. This engaging slot 45 and the drive protrusion 46 constitute an actuation delay mechanism 47 which delays start of rotation of the bevel gear 31. When the outer cylinder 25 rotates on locking operation or release operation, the drive protrusion 46 initially slides on the engaging slot 45, and the bevel gear 31 does not integrally rotate with the cylinder 25, and at the moment the drive protrusion 46 reaches the end of the engaging slot 45, the bevel gear starts to integrally rotate.

This actuation delay mechanism 47 makes the actuation shaft 13 reciprocate in advance and thereafter successively rotate, and this mechanism participates in operations of the locking mechanism 18 and the release code setting mechanism 17 which are later described.

(4) Structure of reciprocating motion mechanism

The reciprocating motion mechanism 14 makes the actuation shaft 13 reciprocate at a predetermined timing and by a predetermined displacement in response to the actuation of the above actuator 7. In this operation, the following elements participate: two recesses **48*a* and 48*b* formed on the outer periphery surface of the outer cylinder 25 and having an angle of 120° between them; three openings 49 provided in the sleeve 30 and in each angle of 120°; a pawl plate 50 which is able to engage with or disengage from kerfs 94 provided in each angle of 120° on the top face of the sleeve 30 on the outer peripheral surface of the outer cylinder 25; and the above compression spring 36**.

Figure 6:
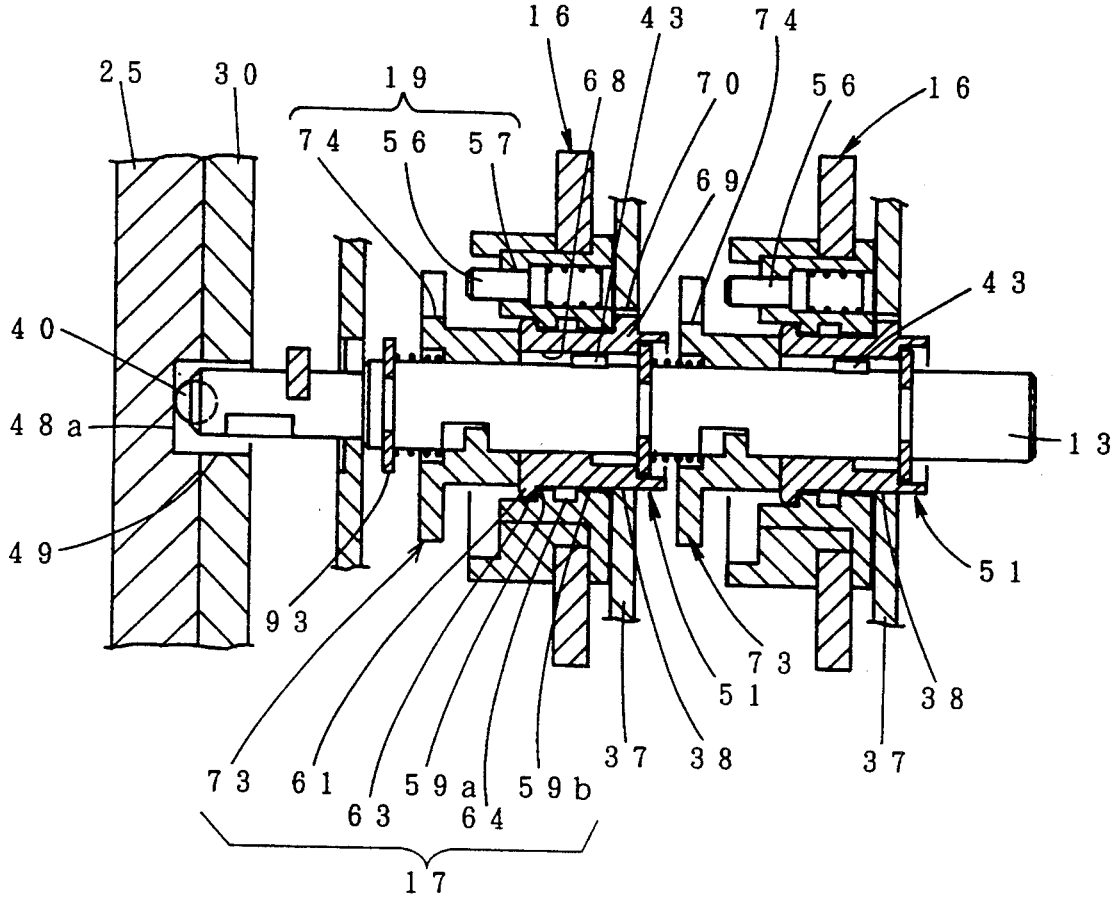
FIG. 6 is a section view showing an important part of an operation of a code lock device which is seen in the direction of "a" in FIG. 2.

In "an open state" shown in FIG. 6, the first recess **48*a* of the outer cylinder 25 and any one of the openings 49 of the sleeve 30 meet and become opposed at the end of the actuation shaft 13. The actuation shaft 13 is pushed by the force of the above compression spring 36, and the end of the actuation shaft 13 tightly enters the first recess 48*a* of the outer cylinder 25 from the opening 49 of the sleeve 30**.

In this state of tight entering, the actuation shaft 13 is displaced closet toward the actuator 7, and this position is hereinafter called "a first displacement position".

Figure 7:
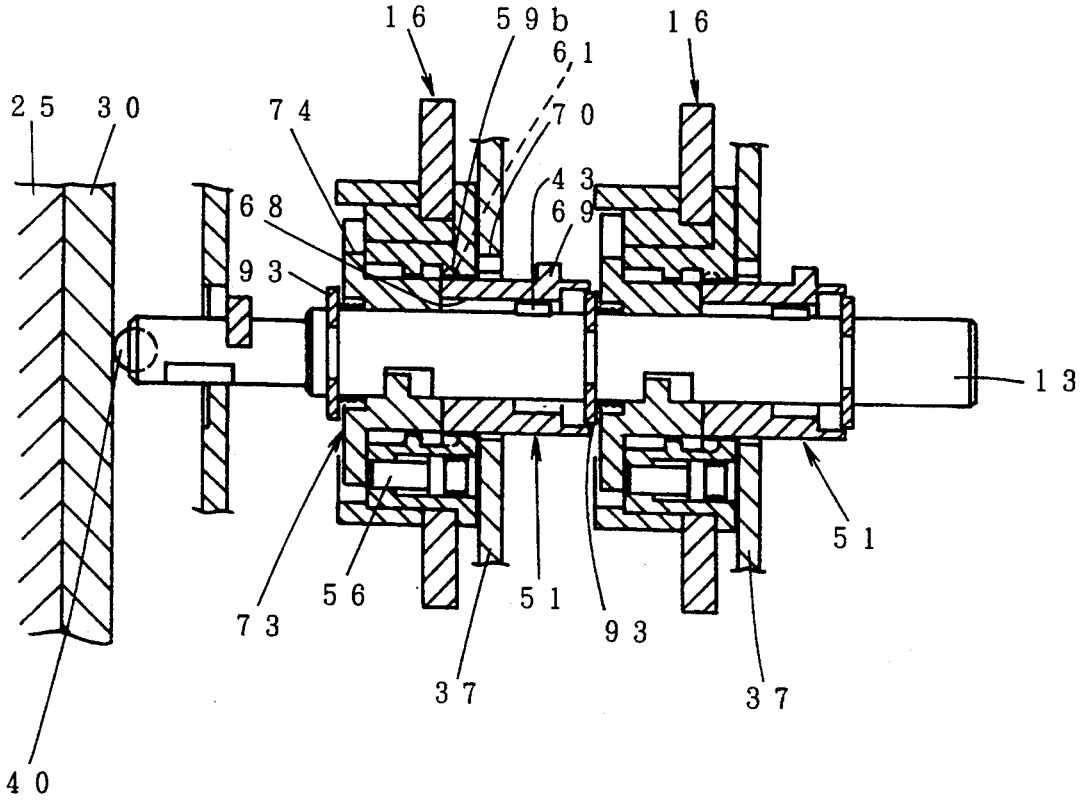
FIG. 7 is a section view showing an important part of an operation of a code lock device which is seen in the direction of "a" in FIG. 2.

In FIG. 7, a state of transition from "an open state" to "a closed state" is shown. In this state, the outer cylinder 25 and the sleeve 30 engage with each other by pawl plate 50 (shown in FIG. 2), and integrally rotate, and as a result the end of the actuation shaft 13 mounts on the outer peripheral surface of the sleeve 30.

In this state of mounting, the actuation shaft 13 is displaced farthest toward the actuator 7, and this position is hereinafter called "a second displacement position".

Figure 8:
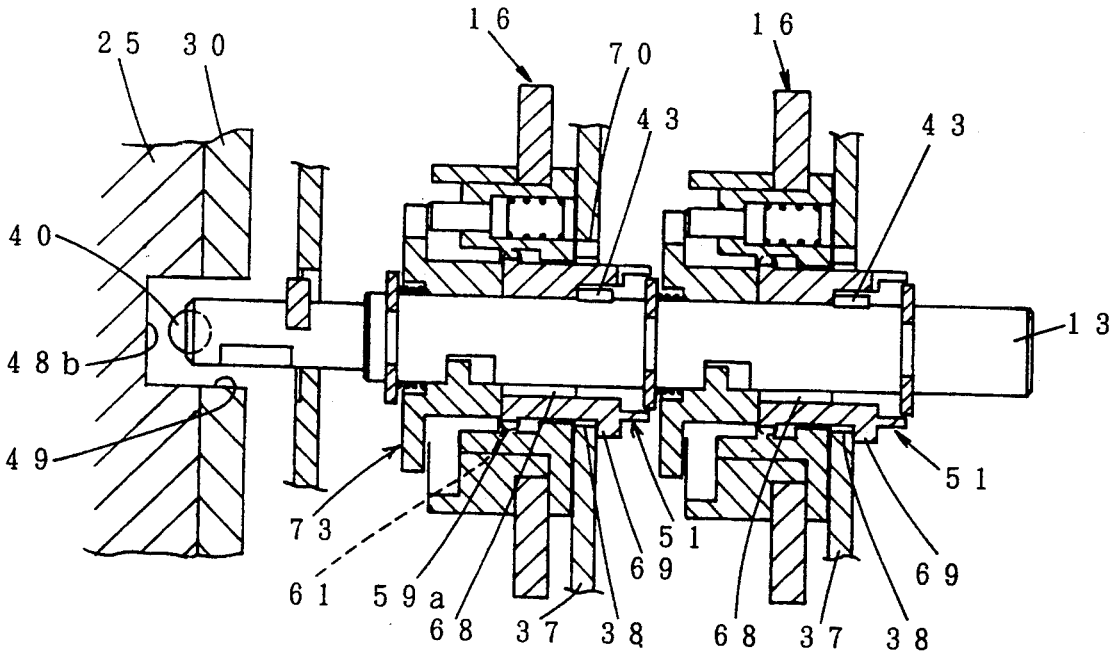
FIG. 8 is a section view showing an important part of an operation of a code lock device which is seen in the direction of "a" in FIG. 2.

In "a closed state" shown in FIG. 8, the second recess **48*b* of the outer cylinder 25 and the opening 49 of the sleeve 30 meet and become opposed at the end of the actuation shaft 13. The actuation shaft 13 is pushed by the force of the compression spring 36, and the end of the actuation shaft 13 is considered to enter the second recess 48*b* of the outer cylinder 25 from the opening 49 of the sleeve 30. However as shown in FIG. 8, an engaging protrusion 69 of a bush 51, which is later described, catches a hole periphery of a circular hole 38 of a partition plate 37, and each protrusion piece 43 of the actuation shaft 13 makes a position-shift to each corresponding engaging slot 68 later described, and the actuation shaft 13** is positioned in the constant middle position between the first displacement position and the second displacement position. This position is hereinafter called "a third displacement position".

Figure 9:
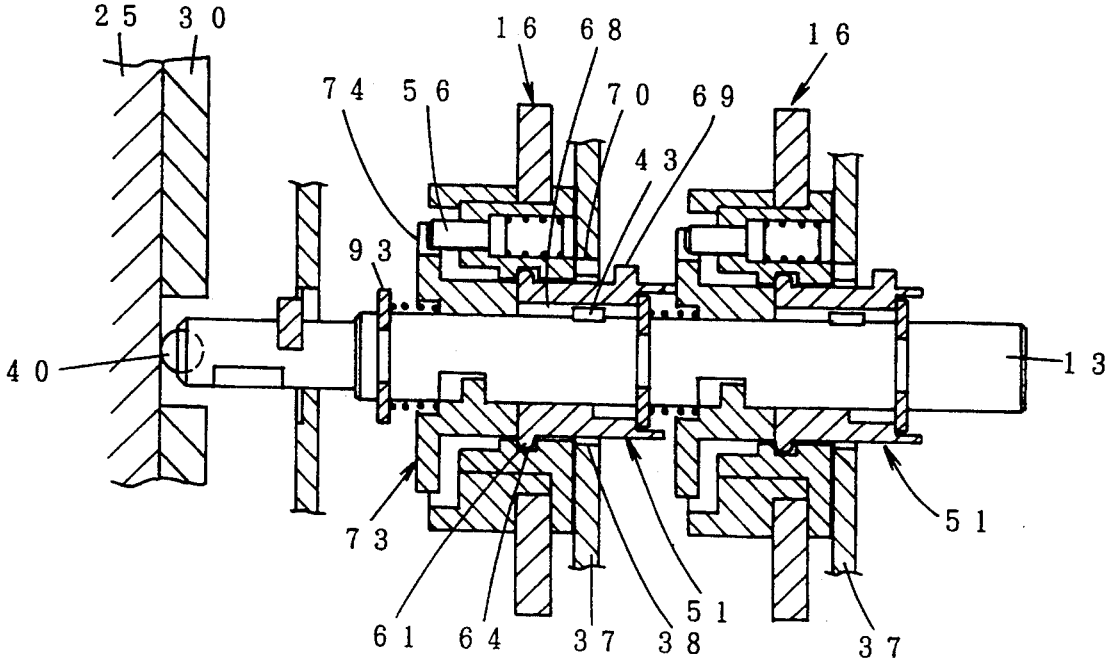
FIG. 9 is a section view showing an important part of an operation of a code lock device which is seen in the direction of "a" in FIG. 2.

In FIG. 9, a state of transition from "a closed state" to "an open state" is shown. In this state, the outer cylinder 25 and the sleeve 30 are disengaged and only the outer cylinder 25 rotates, and the end of actuation shaft 13 mounts on the outer peripheral surface of the outer cylinder 25.

In this mounting state, the actuation shaft 13 is in the constant middle position between the first displacement position and the second displacement position. This position is hereinafter called "a fourth displacement position".

(5) Structure of dial 16

Four dials 16 are rotatably disposed through bushes 51 on each inside of the partition plates 37 on the above actuation shaft 13.

Each dial 16 has a structure in which a dial operation plate 9 and a cam plate 54 are integrally provided at one end of a cylindrical wall 53, and on the peripheral surface of the cylindrical wall 53, numerals "0"–"9" are indicated in each of the same angular positions. On the peripheral surface of the above cam plate 54, troughs 55 (see FIG. 5), the number of which is equal to the number of the numerals, are formed and one trough **55*a* of them is so made that it has a depth deeper than that of other troughs 55**.

On the inside of the each cylindrical wall 53, an engaging pin 56 is so provided that it is parallel to the actuation shaft 13 in a predetermined angular position and can freely go into or out of each pin hole 57, and each engaging pin 56 is activated toward the actuator 7 by each corresponding spring 58.

The above cam plate 54 constitutes the dial intermittent advance mechanism 20 and the dial operation restraining mechanism 21, and the engaging pin 56 and the spring 58 constitute the dial enforced reset mechanism 19 respectively. Details of them will be later described.

(6) Structure of release code setting mechanism 17

The release code setting mechanism 17 is a structure in which the release code series can be freely set and is provided between each dial 16 and each bush 51. Here, the release code series means an arrangement of numerals of the dials 16 which sets a code lock to "a released state" when the above numerals are aligned in the window holes 5, and to "a locked state" when the numerals are not aligned. In addition, in the following explanation, a numeral of each dial 16 which constitutes the release code series is sometimes called "a release code".

As shown in FIGS. 5 and 6, the illustrated release code setting mechanism 17 is constituted of a set of slot lines 59*a* and 59*b* formed on the inner peripheral surface of each dial 16 and protrusion piece lines 61 formed on the outer peripheral surface of one end of each bush 51. The slot lines 59*a*, 59*b* of each dial 16 are formed by disposing engaging slots 60, the number of which is equal to the number of the numerals, taking the same angular spacing on the circumference. While, the protrusion piece line 61 of each bush 51 is formed by disposing engaging protrusion pieces 62 which are engageable with any engaging slot 60 and the number of which is equal to the number of the numerals, taking the same angular spacing on the circumference of the bush 51. Slide slots 63 and 64 are provided on both sides of one slot line 59*a* respectively.

When the protrusion piece line 61 of the bush 51 engages with the slot line 59*a* or 59*b* of the dial 16, the dial 16 and the bush 51 rotate integrally. However, when the protrusion piece line 61 is in the slide slot 63 or 64, the dial 16 disengages from the bush 51 and becomes rotatable by itself. When the actuation shaft 13 is in the above second or the third displacement position, each dial 16 and each corresponding bush 51 engage each other, and when the actuation shaft 13 is in the above first or the fourth displacement position, each dial 16 disengage from a corresponding bush 51.

The angular positions in which the protrusion piece line 61 engage with each slot line 59*a* or 59*b*, that is, the way of engaging the angular position of the dial 16 with bush 51 relies on the number of the numbers of the dial, and thus according to the engagement angular position of both, the release code can be set in 10 ways.

(7) Structure of locking mechanism 18

When every numeral 12 of the dials 16 appearing in each window hole 5 is a release code (when a release code series is formed), the locking mechanism 18 makes the actuator 7 actuate, and when any of the numerals 12 of the dials 16 is not a release code (when the release code series has been broken), the locking mechanism 18 restrains the actuation of the actuator 7.

The locking mechanism 18 of this embodiment comprises: locking pins 66 linked to the actuation shaft 13 through the above movable arm 42; engaging holes 67 (shown in FIG. 11) which are engageable with and disengageable from the above locking pin 66 and are provided in every 120° on the sleeve 30; above four protrusion pieces 43 provided outwardly protrusively on the peripheral surface of the actuation shaft 13; the above engaging slots 68 which are provided on the inner periphery surface of each bush 51 in its longitudinal direction and are engageable with and disengageable from each corresponding protrusion piece 43; each engaging protrusion 69 (see FIG. 6) provided outwardly protrusively on the outer peripheral surface of each bush 51 at its end on the opposed side to the above protrusion piece line 61; and each cutout 70 which is provided in a circular hole 38 of each partition plate 37, engageable with and disengageable from the above engaging protrusion 69.

The above movable arm 42 holds a state of approach of the locking pin 66 to the actuator 7 or a state of separation from the actuator 7 in response to the reciprocating motion of the actuator shaft 13, and one end of the arm is connected to the end of the actuation shaft 13 and the other end is connected to the locking pin 66. The locking pin 66 is provided with a bump piece 71, and the locking pin 66 is activated toward the actuator 7 by connecting a spring 72 to the bump piece 71.

When the actuation shaft 13 is in the first or the fourth displacement position, the movable arm 42 pushes the bump piece 71 of the locking pin 66 against the force of the spring 72 to hold a state of withdrawal of the locking pin 66 (see FIG. 2).

Figure 10:
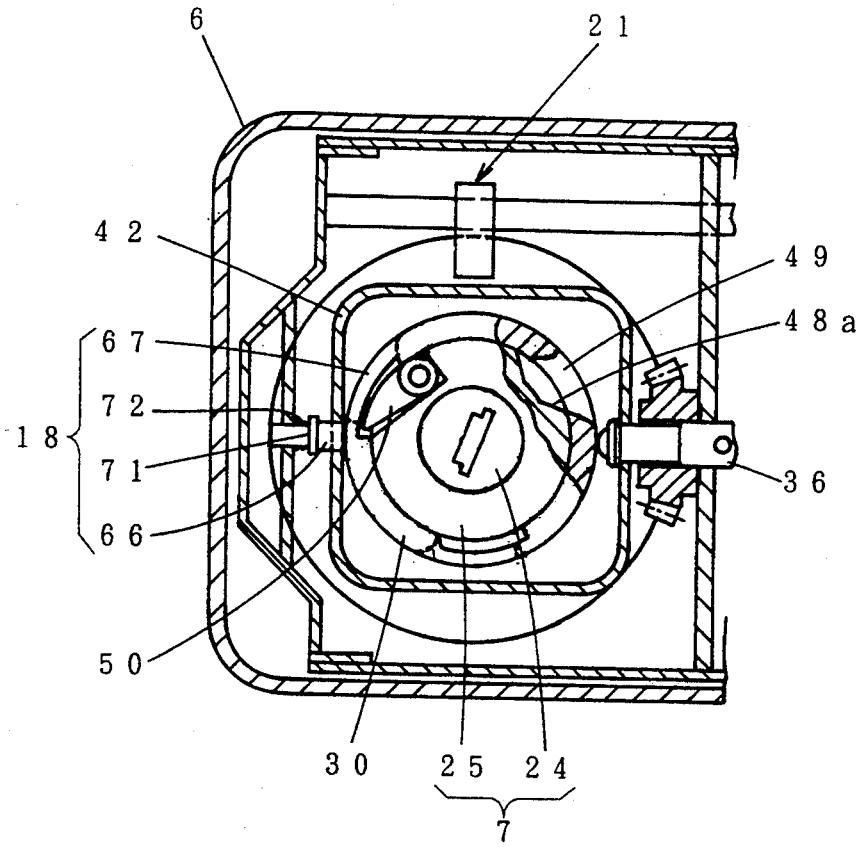
FIG. 10 is a section view showing an important part of an operation of a code lock device which is seen from the plane.
Figure 11:
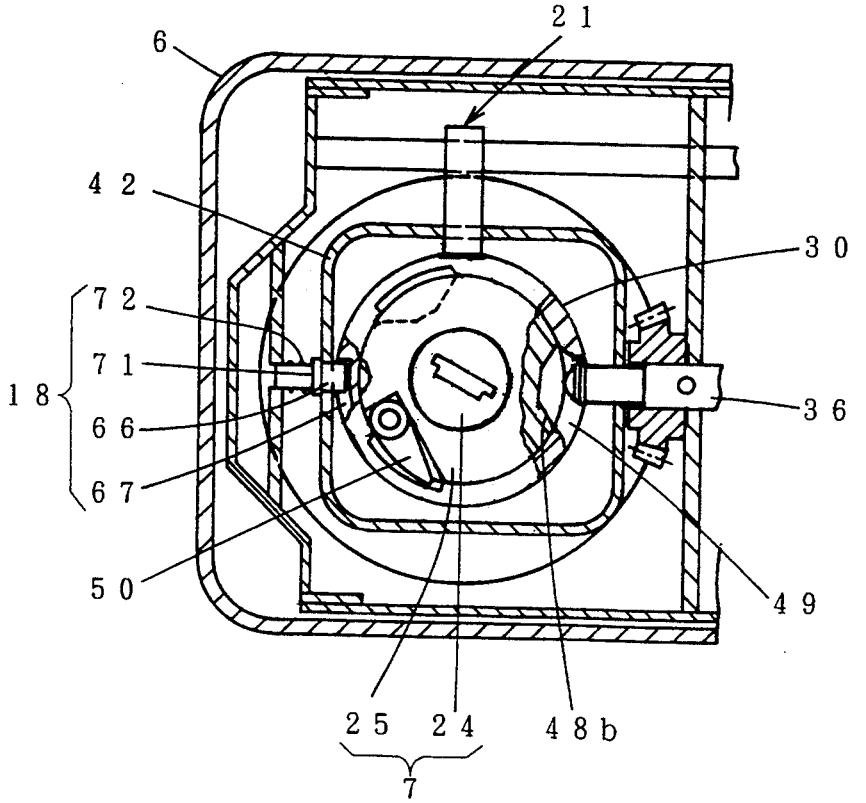
FIG. 11 is a section view showing an important part of an operation of a code lock device is seen from the plane.

When the actuation shaft 13 is in the second displacement position, the holding force of the movable arm 42 to the bump piece 71 is released (see FIG. 10), and when the actuation shaft 13 transfers to the third displacement position, the locking pin 66 becomes opposed to the engaging hole 67 of the sleeve 30 and enters the engaging hole 67 by the force of the spring 72 (see FIG. 11).

When the actuation shaft 13 is in the first or the fourth displacement position, each protrusion piece 43 of the actuation shaft 13 enters each corresponding engaging slot 68 of each bush 51, and each bush 51 and the actuation shaft 13 become integrally rotatable. While when the actuation shaft 13 is in the second or the third displacement position, each protrusion piece 43 escapes from each corresponding engaging slot 68, and each bush 51 becomes independently rotatable to the actuation shaft 13. In this state, if the protrusion piece 43 and the corresponding engaging slot 68 have made a position-shift, the actuation shaft 13 cannot move toward the actuator 7. If the protrusion piece 43 and the corresponding engaging slot 68 are in the same position, the actuation shaft 13 can move toward the actuator 7.

When the actuation shaft 13 is in the first displacement position, the engaging protrusion 69 of each bush 51 is in a state of engagement with the corresponding cutout 70 in the position of each partition plate 37. While, when the actuation shaft 13 is in the second or the third or the fourth displacement position, each engaging protrusion 69 escapes from each corresponding cutout 70 and is on the outside of the partition plate 37.

When the actuation shaft 13 is in the third displacement position, in case the release code does not appear in its window hole 5, the engaging protrusion 69 and the cutout 70 make a position-shift and each bush 51 cannot move toward the actuator 7, that is, the actuation shaft 13 cannot move toward the actuator 7. While, in case the release code appears in its window hole 5, the engaging protrusion 69 and the cutout 70 are in the same position, and each bush 51 can move toward the actuator 7.

(8) Structure of dial enforced reset mechanism 19

The dial enforced reset mechanism 19 of this embodiment relates each dial 16 to a predetermined angular position, breaking the release code series in alignment when transferring the lock device from "an open state" to "a closed state" after setting the release code series, and similarly rotates each dial 16 to the predetermined angular position, breaking the release code series in alignment when transferring the lock device from "a closed state" to "an open state" after aligning the release code series.

In this embodiment, in any case, each dial 16 returns to an angular position in which "0" appears in each corresponding window hole 5, but the mechanism is not limited to this embodiment and other predetermined numerals may appear in each window hole 5.

In order to realize such operations, in this embodiment, on the actuation shaft 13, a disk shape drive plate 73 which integrally rotates with the actuation shaft 13 is so provided, corresponding to each dial 16, that it can reciprocate, while each dial 16 is provided with the engaging pin 56 opposing the outer periphery of the drive plate 73, and on the outer periphery of the drive plate 73, a cutout recess 74 is formed which is engageable with or disengageable from each engaging pin 56.

The actuation shaft 13 makes just one revolution during transition from the above "open state" to "a closed state", and thus the cutout recess 74 of each drive plate 73 is always in the same angular position during "an open state" and "a closed state".

In this embodiment, an angular position of fixing the drive plate 73 to the actuation shaft 13 is so set that the cutout recess 74 is in the uppermost position, that is, on the side of the front plate 3 during "an open state" and "a closed state". On the other hand, a building-in position of each engaging pin 56 to each dial 16 is so set that each engaging pin 56 is in the uppermost position while the dial 16 is in the angular position in which "0" appears in the window hole 5.

Therefore, when the engaging pin 56 and the cutout recess 74 of the drive plate 73 are in the state of engagement during "an open state" or "a closed state", the numeral of each dial 16 which appears in each corresponding window hole 5 is "0".

(9) Structure of dial intermittent advance mechanism 20

The dial intermittent advance mechanism 20 realizes for such an intermittent operation that each numeral of "0"–"9" of each dial 16 appears in order in the window hole 5 and steps at a predetermined number. As shown in FIG. 5, the mechanism 20 comprises: a cam plate 54 provided in each dial 16; a keep plate 76 which is provided in each dial 16 and is capable of moving upward and downward; and a pressure spring 77 which pushes each keep plate 76 to the outer periphery of the cam plate 54.

The lower end of each keep plate 76 is provided with a guide roller 75, dropped in each trough 55 of the cam plate 54 and exerting the pushing pressure of the pressure spring 77 in order to prevent the cam plate 54 from free rotation.

(10) Structure of dial operation restraining mechanism 21

The dial operation restraining mechanism 21 cooperates with the above dial intermittent advance mechanism 20. As shown in FIGS. 2,4, and 5, this mechanism 21 comprises: a drive shaft 78 provided in parallel with the above actuator shaft 13; each tongue piece 79 equipped protrusively on the peripheral surface of the above drive shaft 78, corresponding to a position of each dial 16; restraining piece 80 provided protrusively on the peripheral surface of the drive shaft 78, corresponding to a position of the actuator 7; an engaging hole 81 engageable with and disengageable from the above restraining piece 80 equipped in two positions of the outer cylinder 25.

In the case of the locking operation and the release operation, in order to make users operate a key after a setting operation or an alignment operation of the release code series, this dial operation restraining mechanism 21 has a structure in which actuator 7 cannot rotate even when turning the key under the reset condition, that is, four "0"s are arranged in a row.

In order to realize such operations, correlation of positions for providing the restraining piece 80 and each tongue piece 79 is so set that the engaging hole 81 and the restraining piece 80 are in opposed positions during "an open state" or "a closed state", and each tongue piece 79 becomes horizontal when the restraining piece 80 enters the engaging hole 81, while the length and the height of each keep plate 76 are so set that the top end of the keep plate 76 and the bottom of each tongue piece 79 become opposed-contacted at the same heights when each keep plate 76 is in its descended state, that is, in the state that the guide roller 75 of each keep plate 76 has dropped in the deep trough 55*a* of the corresponding cam plate 54.

Therefore, in the state of zero reset, that is, four "0"s in a row, the guide rollers 75 of all the keep plates 76 drop into the deep trough 55*a* of the corresponding cam plate 54, and the restraining piece 80 enters the engaging hole 81: However when any of the dials 16 is operated and the corresponding cam plate 54 rotates, the guide roller 75 of the keep plate 76 corresponding to this cam plate 54 is guided into a shallow trough 55 to push the keep plate 76, and thus the drive shaft 78 rotates and the restraining piece 80 escapes from the engaging hole 81 to release the actuator 7.

(11) Structure of return operation prevention mechanism 22

Figure 13:
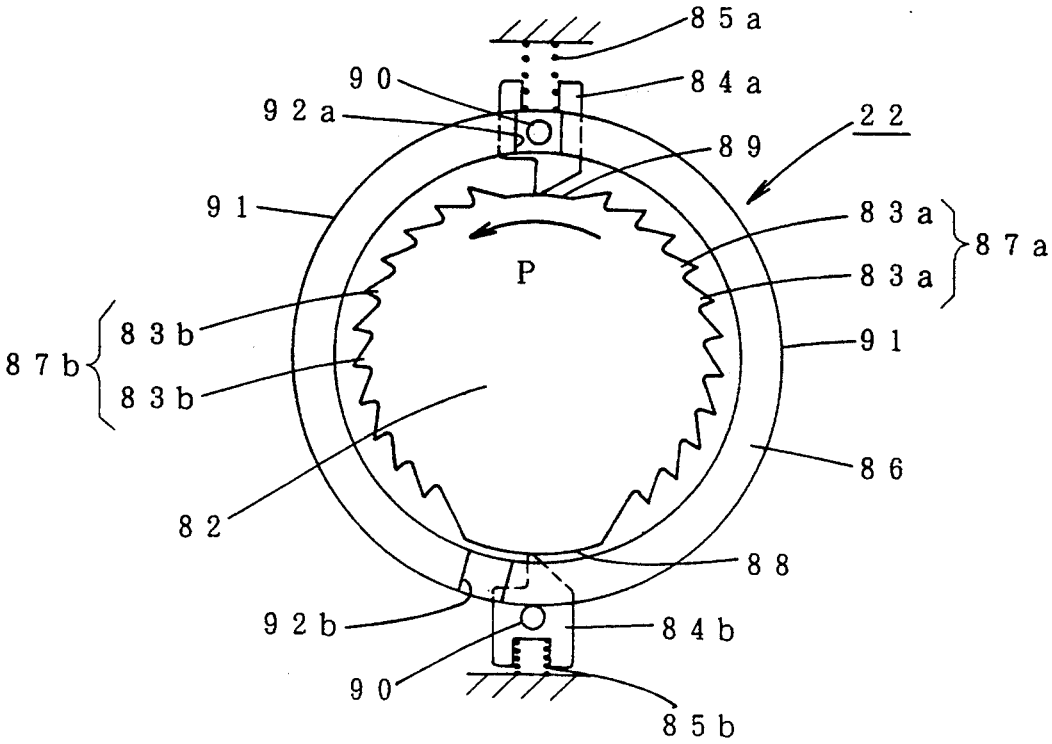
FIG. 13 is a plane view showing a structure of a return operation prevention mechanism.

The return operation prevention mechanism 22 restrains a return operation in a reverse direction during the locking operation or the release operation and prevents each mechanism from malfunctions and damages. As shown in FIG. 13, this mechanism 22 comprises; a ratchet plate 82 which integrally rotates with the outer cylinder 25; a pair of pawl plates 84*a* and 84*b* which engage with gear teeth 83*a* and 83*b* of the outer periphery of the above ratchet plate 82; springs 85*a* and 85*b* which activate the above pawl plates 84*a* and 84*b* toward the above ratchet plate 82; and a control ring 86 which controls positions of the above pawl plates 84*a* and 84*b* to the above ratchet plate 82, fitted on the outer periphery of the outer cylinder 25.

The above ratchet plate 82 has a first and a second engaging portion 87*a* and 87*b* which are provided with reversely directed teeth 83*a* and 83*b* disposed in symmetric positions within a range less than 180° each, and a large diameter portion 88 and a small diameter portion 89 formed between the engaging portions 87*a* and 87*b*.

The above pawl plates 84*a* and 84*b* are disposed in outside positions of the ratchet plate 82 periphery and at both elongation points of the ratchet plate 82 diameter, and one side edge of the pawl is made vertical and the other side edge is made slant and a guide pin 90 is protrusively provided in the center of the pawl plate.

The outer peripheral surface of the above control ring 86 serves as a pin-holding face 91, and two guide holes 92*a* and 92*b*, which engage with and disengage from the guide pins 90 of the pawl plates 84*a* and 84*b* respectively, are provided in positions sifted by a predetermined angle from the diagonal positions. This control ring 86 is so made that it integrally rotates with the outer cylinder 25 by a constant angle just before finish of the locking operation or the release operation. In order to realize this performance, a slide slot (not shown) which covers an angular range less than 180° is formed on the outer periphery of the outer cylinder 25, and on the other hand, a protrusion (not shown) which engages with the above slide slot is formed on the periphery of the ring 86.

In "an open state" shown in FIG. 13, the guide pin 90 of the first pawl plate 84*a* fits into guide hole 92*a* and the tip of the pawl plate 84*a* strikes against the small diameter portion 89 of the ratchet plate 82, and the second pawl plate 84*b* is pushed up by the large diameter portion 88 of the ratchet plate 82 to support the guide pin 90 by the pin supporting face 91 of the control ring 86.

When the actuator 7 rotates in the direction of the arrow P of FIG. 13 by the locking operation, the outer cylinder 25 rotates without engagement of the first pawl plate 84*a* with the first engaging portion 87*a*. During this rotation, if an operation in the reverse direction is performed, the pawl plate 84*a* and the first engaging portion 87*a* engage to prevent the reverse rotation.

Just before finish of the locking operation, the first pawl plate 84*a* is pushed up by the large diameter portion 88 of the ratchet plate 82 and the guide pin 90 mounts on the pin supporting face 91 of the control ring 86 by rotation of the control ring 86 to be supported. On the other hand, the guide pin 90 of the second pawl plate 84*b* is pushed by the force of the spring 85*b* to fit into the guide hole 92*b* and strike the small diameter portion 89 of the ratchet plate 82.

In the release operation, the second pawl plate 84*b* and the second engaging portion 87*b* engage each other, in the same way as that mentioned above, and therefore, the explanation will be omitted here.

Next, a series of performances of the code lock device comprising the above mechanisms during the locking operation and the release operation, mainly the dial enforced reset mechanism 19 which features the present invention will be explained.

First, performances during the locking operation will be explained. When the code lock device is in "an open state" shown in FIGS. 2–6, the end of the actuation shaft 13 fits into the first recess 48*a*, and the actuation shaft 13 is in the state of the closest displacement toward the actuator 7 (first displacement position). In this first displacement position, each dial 16 can freely rotate due to the releasing engagement with each corresponding bush 51, that is, in a state of disengagement between the slot lines 59*a*, 59*b* and the protrusion line 61, and free setting of the release codes is possible.

When setting an arbitrary release code by rotating the dial operation plate 9 of each dial 16, the restraining piece 80 of the dial operation restraining mechanism 21 is released and the code lock device is set to a state in which the locking operation is possible.

Then, inserting a key and rotating, first the end of the actuation shaft 13 mounts on the outer periphery of the sleeve 30, as a result the actuation shaft 13 being displaced in the direction reverse to the actuator 7 and transfers to the second displacement position shown by FIG. 7, and thereafter the rotation of the actuator 7 is transmitted via the rotation mechanism 15 to the actuation shaft 13 to rotate it.

On the second displacement position before the actuation shaft 13 rotates, the drive plate 73 and the bush 51 of each dial 16 are pushed by each pushing ring 93 to make each bush 51 and each dial 16 engage each other, that is, to provide engagement between the protrusion line 61 and the first slot line 59*b*, and the set release code is stored.

On the other hand, each drive plate 73 is near the corresponding dial 16, and when each engaging pin 56 and the corresponding cutout recess 74 of each drive plate 73 come to the same position, each corresponding drive plate 73 is set to a state in which it can engage with the corresponding dial 16.

In this state, engagement between the actuation shaft 13 and each bush 51 has been released because the protrusion piece 43 has escaped from each corresponding engaging slot 68, and furthermore the engaging protrusion 69 of each bush 51 has escaped from the cutout 70 of the partition plate 37.

In such a state, when the actuation shaft 13 rotates, the drive plate 73 integrally rotates with the shaft 13, and in each dial 16, the cutout recess 74 engages with the engaging pin 56 in a set angular position corresponding to a release code and thereafter each dial 16 and each corresponding bush 51 rotate integrally. Thereby, the engaging slot 68 of each bush 51 causes a position-shift to the corresponding protrusion piece 43, and the engaging protrusion 69 of each bush 51 makes a position-shift to each corresponding cutout 70.

When the actuation shaft 13 makes one revolution and the cutout recess 74 of each drive plate 73 reaches the uppermost position, the numeral "0" of each dial 16 appears in each corresponding window hole 5.

When the code lock device reaches "a closed state" shown in FIG. 8, the end of the actuation shaft 13 becomes opposed to the second recess 48*b* of the outer cylinder 25 and transfers toward the actuator 7 to go to the third displacement position. As a result, the engaging protrusion 69 of each bush 51 engages with the hole peripheral edge of the circular hole 38 of the partition plate 37, and each protrusion piece 43 of the actuation shaft 13 engages with each bush 51 to produce a locked state. At this time each bush 51 and each dial 16 are in a state of engagement because each protrusion piece line 61 and each corresponding slot line 59*a* engage each other.

Next, performances during the release operation will be explained, when the code lock device is in "a closed state" shown in FIG. 8, each dial 16 is in a state of engagement with each bush 51 and each bush 51 is in a state of disengagement from the actuation shaft 13, and a code of each dial 16 can be set to a corresponding code of the release code series which was set.

When the release code series is aligned by turning the dial operation plate 9 of each dial 16, the engaging slot 68 of each bush 51 meets each corresponding protrusion piece 43, furthermore the engaging protrusion 69 of each bush 51 meets the cutout 70 of the partition plate 37.

Then, when turning the key, only the outer cylinder 25 rotates leaving the sleeve 30, and the end of the actuation shaft 13 mounts on the outer periphery of the outer cylinder 25. As a result, the actuation shaft 13 transfers to the fourth displacement position shown in FIG. 9, and thereafter the rotation of the actuator 7 is transmitted via the rotation mechanism 15 to the actuation shaft 13 to rotate it.

On the fourth displacement position before the actuation shaft 13 rotates, the drive plate 73 and the bush 51 of each dial 16 are pushed by each corresponding pushing ring 93 to make each bush 51 disengage from each corresponding dial 16, that is, to make the protrusion piece line 61 be in the slide slot 64.

On the other hand, each drive plate 73 is near each corresponding dial 16, and when the cutout recess 74 of each drive plate 73 comes to a position of the engaging pin 56, both of them can engage each other.

In this state, the actuation shaft 13 and each bush 51 engage each other because each protrusion piece 43 engages with each corresponding engaging slot 68, furthermore the engaging protrusion 69 of each bush 51 disengages from each corresponding hole peripheral edge of the circular hole 38 of the partition plate 37.

In such a state, when the actuation shaft 13 rotates, each drive plate 73 integrally rotates with the shaft 13, and the cutout recess 74 of each dial 16 engages with each corresponding pin 56 in a set angular position corresponding to a release code, and thereafter the shaft 13 integrally rotates only with each dial 16. When the actuation shaft 13 makes one revolution and each cutout recess 74 of the drive plate 73 reaches the uppermost position, the numeral "0" of each dial 16 appears in each corresponding window hole 5 and the first recess 48*a* meets the opening 49, both of them become opposed to each other at the end of the actuation shaft 13, and the actuation shaft 13 transfers toward the actuator 7 and enters the state shown in FIG. 6.

What is claimed is:

1. A code lock device comprising:

an actuator responding to a release operation and a locking operation;

an actuation shaft capable of reciprocating motion and rotation in first and second opposite directions;

reciprocating mechanism means, provided between said actuator and said actuation shaft, for reciprocating the actuation shaft in response to actuation of the actuator;

rotation mechanism means, provided between said actuator and said actuation shaft, for rotating the actuation shaft in response to actuation of the actuator;

a plurality of dials rotatably mounted on said actuation shaft;

locking mechanism means for allowing actuation of the actuator when a code of each dial is in an alignment forming a release code series, and for restraining the actuation of the actuator when the code of each dial is in non-alignment;

a plurality of drive plates, each of which corresponds to each said dial and integrally rotates with said actuation shaft;

a dial enforce reset mechanism including engaging means, provided between each said drive plate and each corresponding dial, for engaging both in response to reciprocating motion and rotation of the actuation shaft, and for rotating each dial to a predetermined angular position.

2. A code lock device according to claim 1, wherein each said dial is rotatably provided through a bush on said actuation shaft; and engaging means for setting an arbitrary release code series responding to an engagement angular position, is provided between each said dial and a corresponding bush.

3. A code lock device comprising:

an actuator responding to a release operation and a locking operation, said actuator including a rotatable cylinder;

an actuation shaft capable of reciprocating motion and rotation in first and second opposite directions;

reciprocating mechanism means, provided between said actuator and said actuation shaft, for reciprocating the actuation shaft in response to actuation of the actuator;

rotation mechanism means, provided between said actuator and said actuation shaft, for rotating the actuation shaft in response to actuation of the actuator, said rotation mechanism means including a first bevel gear on said actuation shaft and a second bevel gear on said rotatable cylinder of said actuator and in meshing engagement with said first bevel gear;

a plurality of dials rotatably mounted on said actuation shaft;

locking mechanism means for allowing actuation of the actuator when a code of each dial is in an alignment forming a release code series, and for restraining the actuation of the actuator when the code of each dial is in non-alignment;

a plurality of drive plates, each of which corresponds to each said dial and integrally rotates with said actuation shaft;

a dial enforce reset mechanism including engaging means, provided between each said drive plate and each corresponding dial, for engaging both in response to reciprocating motion and rotation of the actuation shaft, and for rotating each dial to a predetermined angular position.

4. A code lock device according to claim 3, wherein each said dial is rotatably provided through a bush on said actuation shaft; and engaging means for setting an arbitrary release code series responding to an engagement angular position, is provided between each said dial and a corresponding bush.

* * * * *